US010920577B2

(12) United States Patent
El Mallawany

(10) Patent No.: US 10,920,577 B2
(45) Date of Patent: Feb. 16, 2021

(54) POSITION SENSING FOR DOWNHOLE TOOLS

(71) Applicant: Halliburton Energy Services, Inc., Houston, TX (US)

(72) Inventor: Ibrahim El Mallawany, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 34 days.

(21) Appl. No.: 15/745,638

(22) PCT Filed: Sep. 22, 2016

(86) PCT No.: PCT/US2016/053163
§ 371 (c)(1),
(2) Date: Jan. 17, 2018

(87) PCT Pub. No.: WO2018/056991
PCT Pub. Date: Mar. 29, 2018

(65) Prior Publication Data

US 2019/0017368 A1 Jan. 17, 2019

(51) Int. Cl.

| | |
|---|---|
| ***E21B 47/09*** | (2012.01) |
| ***E21B 23/04*** | (2006.01) |
| ***E21B 17/02*** | (2006.01) |
| ***E21B 34/06*** | (2006.01) |
| ***E21B 34/10*** | (2006.01) |

(52) U.S. Cl.
CPC ..... *E21B 47/09* (2013.01); *E21B 17/02* (2013.01); *E21B 23/04* (2013.01); *E21B 34/06* (2013.01); *E21B 34/10* (2013.01)

(58) Field of Classification Search
CPC ..... E21B 17/02; E21B 23/04; E21B 34/06; E21B 34/10; E21B 47/09
See application file for complete search history.

(56) References Cited

U.S. PATENT DOCUMENTS 6,021,652 A * 2/2000 Walker ..... D06F 43/00 137/554
2006/0278399 A1 12/2006 Dwivedi et al.
2007/0163774 A1 7/2007 Hosatte et al.
(Continued)

OTHER PUBLICATIONS

International Search Report and Written Opinion for Application No. PCT/US2016/053163 dated Mar. 20, 2017.

*Primary Examiner* — Caroline N Butcher
(74) *Attorney, Agent, or Firm* — Scott Richardson; C. Tumey Law Group PLLC

(57) ABSTRACT

A system and method for a position sensor system in a well system. A position sensor system may comprise a downhole tool, a position sensor attached to the downhole tool such that resistance of the position sensor changes with position of the downhole tool, a first conductor attached to the position sensor, and a second conductor attached to the position sensor as an electrical ground. A method for determining position of a downhole tool may comprise taking a first measurement of a line resistance and moving the downhole tool, wherein moving the downhole tool increases or decreases the line resistance. The method may further comprise taking a second measurement of the line resistance, wherein the second measurement provides an indication of the position of the downhole tool.

19 Claims, 3 Drawing Sheets

(56) References Cited

U.S. PATENT DOCUMENTS

| | | | | |
|---|---|---|---|---|
| 2009/0071717 | A1* | 3/2009 | Gissler | E21B 47/09 175/45 |
| 2010/0038093 | A1 | 2/2010 | Patel | |
| 2011/0056288 | A1* | 3/2011 | Smithson | E21B 23/00 73/152.54 |

* cited by examiner

POSITION SENSING FOR DOWNHOLE TOOLS

BACKGROUND

Oil and gas wells formed in the earth often traverse several formation layers or regions of the earth, which may include one or more hydrocarbon reservoirs. Production tubing may be disposed in the well and production fluid from the hydrocarbon reservoirs flows to the surface through the production tubing. During some production operations, it may be beneficial to independently control the flow of fluid from different regions of the reservoirs into the production tubing. Packers may be disposed in an annulus between the wellbore and the production tubing to isolate the reservoir into different zones.

Each corresponding portion of the production tubing may include a valve. When the valve is open, fluid may flow from the respective reservoir zone into the production tubing. When the valve is closed, fluid from the respective reservoir zone may be prevented from flowing into the production tubing. Thus, the flow of fluid from each zone into the production tubing may be controlled by controlling the opening and closing of the corresponding valve, which may choke a valve by partially opening the valve to a desired position In many systems, opening and closing of each valve may be controlled and monitored through the movement of hydraulic fluid through a system. Controlling the valve choking position hydraulically through hydraulic control lines and or flow regulators, which control a valve within production tubing may be imprecise and may require a trial and error method. Additionally, other methods of position sensing may require expensive permanent gauges with complex electronics.

BRIEF DESCRIPTION OF THE DRAWINGS

For a detailed description of the embodiments of the invention, reference will now be made to the accompanying drawings in which.

DETAILED DESCRIPTION

The present disclosure provides methods and systems for monitoring position of controlling and/or positioning any number of or elements of similar function, with two conductor lines.

Figure 1:
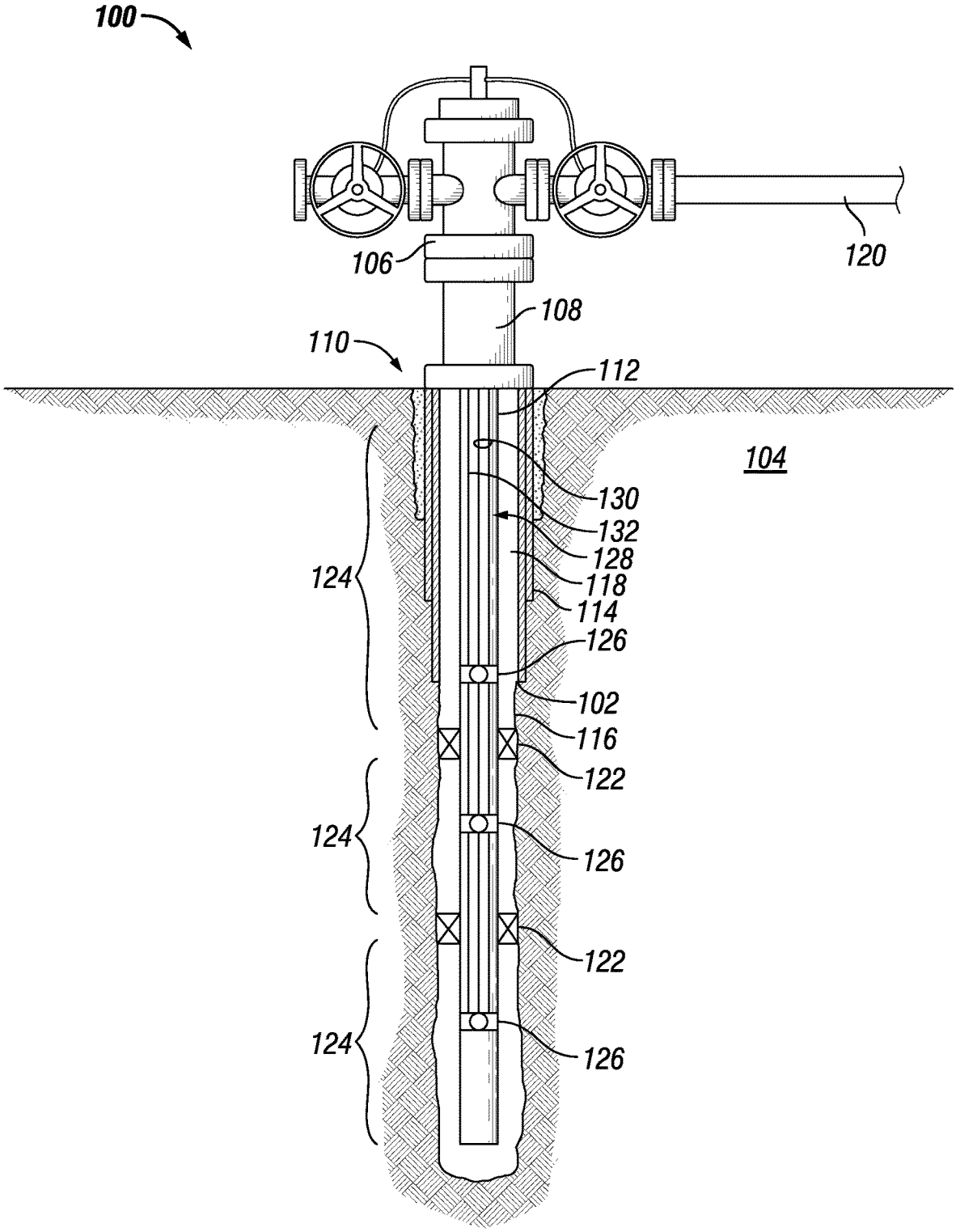
FIG. 1 illustrates a well system with a multi-zone control system.

FIG. 1 illustrates a well system 100 with isolated production zones. Well system 100 may comprise a wellbore 102 formed within a formation 104. Wellbore 102 may be a vertical wellbore as illustrated or it may be a horizontal and/or a directional well. While well system 100 may be illustrate as land-based, it should be understood that the present techniques may also be applicable in offshore applications. Formation 104 may be made up of several geological layers and include one or more hydrocarbon reservoirs. As illustrated, well system 100 may include a production tree 106 and a wellhead 108 located at a well site 110. A production tubing 112 may extend from wellhead 108 into wellbore 102, which may traverse formation 104.

Without limitation, wellbore 102 may be cased with one or more casing segments 114. Casing segments 114 help maintain the structure of wellbore 102 and prevent wellbore 102 from collapsing in on itself. In some embodiments, a portion of the well may not be cased and may be referred to as "open hole." The space between production tubing 112 and casing segments 114 or wellbore wall 116 may be an annulus 118. Production fluid may enter annulus 118 from formation 104 and then may enter production tubing 112 from annulus 118. Production tubing 112 may carry production fluid uphole to production tree 106. Production fluid may then be delivered to various surface facilities for processing via a surface pipeline 120.

Wellbore 102 may be separated into a plurality of zones with packers 122 disposed in annulus 118. Packers 122 may separate wellbore 102 into isolated zones 124. Each portion of production tubing 112 disposed within one of the zones 124 may comprise a production tubing valve 126. When one of the production tubing valves 126 is open, fluid may flow from the respective zone 124 into production tubing 112. When the respective one of the production tubing valves 126 is closed, fluid from the respective zone 124 is prevented from flowing into production tubing 112. Thus, the flow of fluid from each zone 124 into production tubing 112 may be controlled by controlling the opening and closing of the corresponding production tubing valve 126. In examples, the flow of fluid may be increased or decrease incrementally by "chocking" production tubing valve 126. Chocking production tubing valve 126 may be defined as partially opening or partially closing production tubing valve 126. Without limitation, production tubing valves 126 may be partially open or partially closed by twenty five percent, fifty percent, or seventy five percent. Additionally, production tubing valves 126 may be opened or closed between one percent and ninety nine percent.

Figure 2:
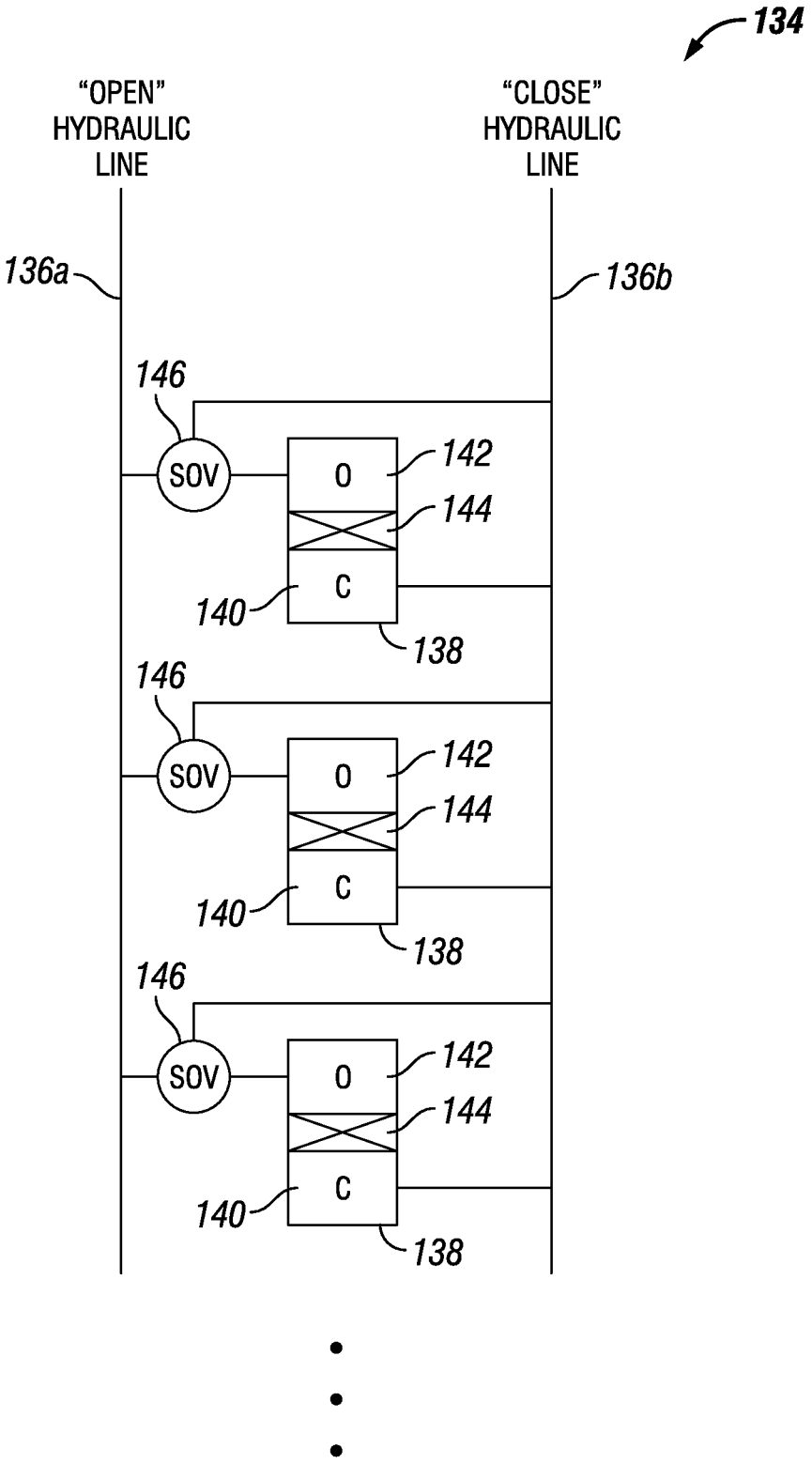
FIG. 2 is a schematic of a hydraulic portion of the multi-zone control system.

In some examples, production tubing valves 126 may be operated hydraulically and controlled by a valve control system 128. Valve control system 128 comprises a hydraulic system 134 with two hydraulic lines 130 and an electrical system with an electrical line 132. A schematic illustrating a hydraulic system 134 of valve control system 128 is illustrated in FIG. 2. In examples, hydraulic system 134 may control the position of production tubing valves 126. Hydraulic system 134 may comprise an open hydraulic line **136*a*, a close hydraulic line 136*b*, and a piston device 138 coupled to each production tubing valve 126. During operation, the movement of piston device 138 may move production tubing valve 126, which may incrementally open and/or close production tubing valve 126. Thus, increasing hydraulic pressure through open hydraulic line 136*a* may move piston device 138, which in turn may move production tubing valve 126 toward an open position. Increasing hydraulic pressure through closed hydraulic line 136*b* may move piston device 138, which in turn may move production tubing valve 12 toward a closed position. Each piston device 138 may comprise a close chamber 140 and an open chamber 142, separated by a piston 144. The close chamber 140 may be hydraulically coupled to close hydraulic line 136*b*. The open chamber 142 may be hydraulically coupled to an electrically powered device such as a solenoid operated valve ("SOV") 146 that may be coupled to both the open hydraulic line 136*a* and the close hydraulic line 136*b*. Without limitation, SOVs 146 may be replaced by motors or other devices configured to couple and/or decouple hydraulic lines similarly to the SOVs upon receiving an electric current. In addition SOVs 146** may be replaced by motors or actuators that directly move the valve and eliminate the need for the hydraulic control lines.

Piston 144 may be configured to move when there may be a pressure differential between closed chamber 140 and open chamber 142, thereby opening and/or closing the respective production tubing valve 126. Thus, in order to close production tubing valve 126, the closed chamber 140 may be pressurized via closed hydraulic line 136*b*, bleeding open chamber 142 through open hydraulic line 136*a*. Piston 144 and the corresponding production tubing valve 126 may be thereby moved into a closed position. Inversely, in order to open a production tubing valve 126, open chamber 142 may be pressurized via the open hydraulic line 136*a* and closed chamber 140 may be bled through the closed hydraulic line 136*b*. In both cases, a pressure differential between the open hydraulic line 136*a* and the close hydraulic line 136*b* may be applied.

However, multiple piston devices 138 may be controlled on the same open hydraulic line 136*a* and close hydraulic line 136*b*. Thus, in order to operate each the production tubing valves 126 independently and one at a time, one of closed chambers 140 or open chamber 142 of each piston device 138 may be coupled to an SOV 146.

When there is no current flowing through an SOV 146 (e.g., SOV 146 may not actuated), open chamber 142 may be hydraulically coupled to closed hydraulic line 136*b* and separated from open hydraulic line 136*a*, and thus not affected by hydraulic pressure in open hydraulic line 136*a*. When a current may flow through SOV 146 (i.e., SOV 146 may be actuated), open chamber 142 may be connected to the open hydraulic line 136*a* and separated from the close hydraulic line 136*b*. Thus, production tubing valve 126 may be controlled independently by actuating the corresponding SOV 146 and keeping the other SOVs 146 unactuated. SOVs 146 may be controlled via the electrical system of valve control system 32.

Figure 3:
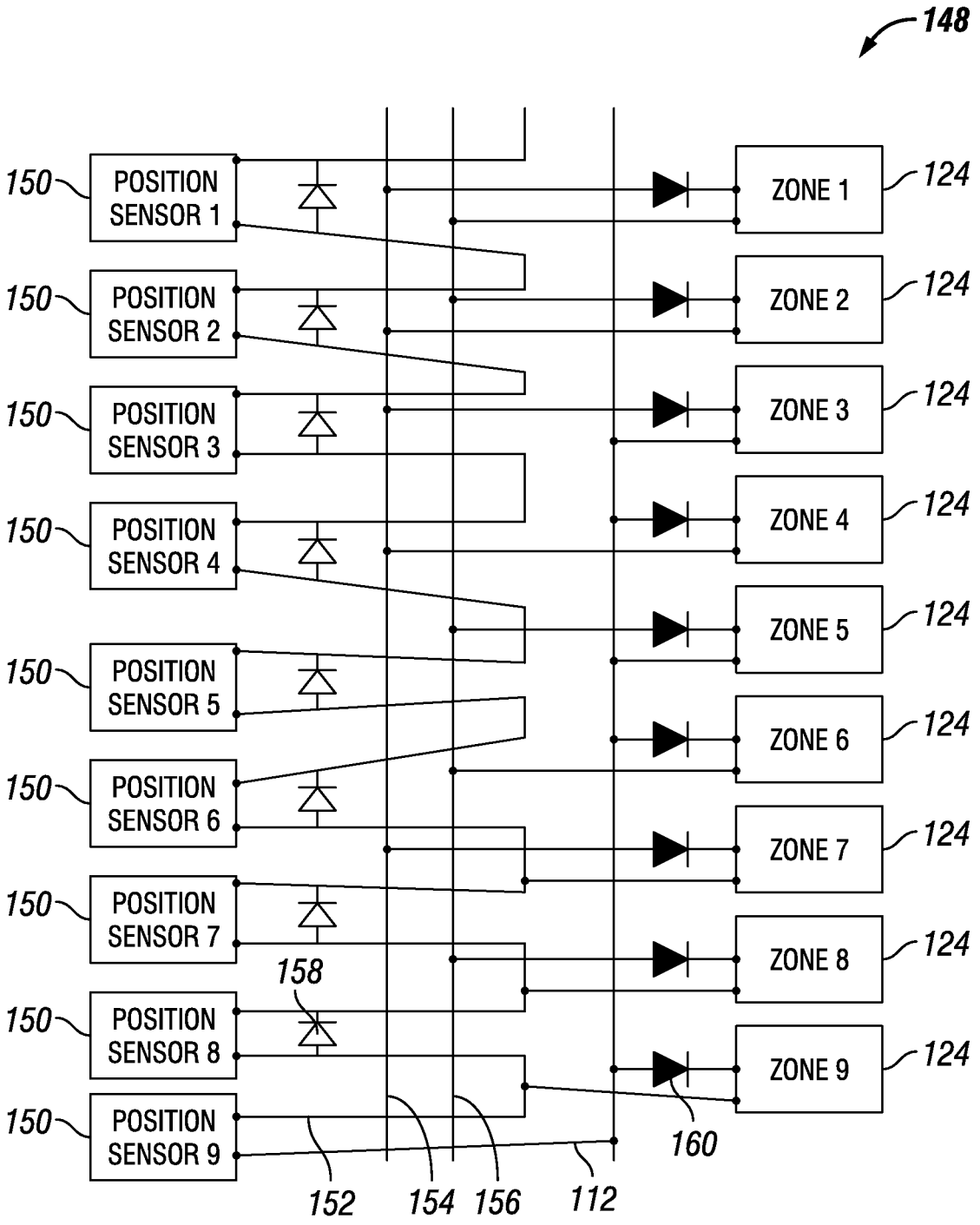
FIG. 3 is a schematic of an electric system which enables a position sensor to determine the position of valves in the hydraulic portion of the multi-zone control system.

In examples, as illustrated in FIG. 3, valve control system 128 (referring to FIG. 2) may comprise a position sensor system 148. Position sensor system 148 may be implemented to sense position of production tubing valves in place of gauges and/or a scoring and ranking assessment models comprise nine position sensors 150, which may be associated with individual zones 124. Positions sensors 150 may comprise a potentiometer that is directly or magnetically coupled with the valve's piston such that the resistance of the potentiometer changes with the piston position. As discussed above, zones 124 may be separated by packers 122. Each of the zones 124 may comprise production tubing valves 126 (e.g. illustrated in FIG. 1). In examples, position sensor system 148 may comprise a first conductor 152, a second conductor 154, and a third conductor 156. It should be noted that production tubing 112, as illustrated in FIG. 3, may represent an electrical ground for position sensor system 148. Position sensor system 148 may determine at what position production tubing valves 126 may be positioned. For example, without limitation, production tubing valves 126 may be disposed as fully open, completely closed, and/or between fully open and completely closed. Determining the position of production tubing valves 126 may be found with first conductor 152 and production tubing 112.

The position of production tubing valves 126 may be determined by measuring the resistance between first conductor 152 and production tubing 112. In examples, first conductor 152 may supply power to position sensors 150 in position sensor system 148. Power may be supplied to position sensors 150 from the surface through first conductor 152. Position sensors 150 may be connected in series along first conductor 152 and a final position sensor may be electrically grounded through production tubing 112, which may electrically ground every position sensor 150. Resistance measured between first conductor 152 and production tubing 112 may indicate the position of production tubing valves 126. Without limitation, production tubing valves 126 may have any number of positions, such as fully open, completely closed, half way open, a quarter way open, and/or three quarters open, etc. In examples, the least resistance measured may be found in a first position and may increase in resistance as production tubing valves 126 move to higher positions. It should be noted that a first position may be fully open or completely closed, which may depend on how production tubing valves are designed.

Without limitation, the increase in resistance from one position to another may be known. For example, moving from a first position to second position may increase the measured resistance in first conductor 152 and production tubing 112 by a known resistance increase. Thus, moving from a first position to a fourth position may increase the measured resistance, which may be calculated as three time the known resistance increase. For example, if the movement between positions increases the line resistance by one hundred ohms, the movement from a first position to a fourth position may be a movement through three positions. Thus, the line resistance would increase by three hundred ohms, or three times the known resistance. This may allow any position sensor 150 to move between positions and the increase or decrease of measured resistance may indicate at what position production tubing valve 126 may have moved.

However, in examples the positions of production tubing valves 126 may not be known. For example due to thermal effects on resistance. To track the movement between positions, each production tubing valve 126 may be calibrated individually. As an example this may be done by closing a production tubing valve 126, and taking a resistance measurement, opening production tubing valve 126 and taking another measurement. The difference between the two measurements may be used to calibrate production tubing valve 126. For example, it may be desirable to open production tubing valve 126 half way, production tubing valve 126 may be moved till the difference in resistance is half of that measured between open and closed. The open and closed positions were used in the example because it is easy to achieve those positions with certainty by purely depending on hydraulic system 134 however depending on production tubing valve 126 other positions may be used to calibrate each production tubing valve 126. The same steps may be replicated for each production tubing valve 126 on well system 100. Since the calibration of production tubing valves 126 may depend on the relative change in resistance, the overall resistance of well system 100 may not affect it. So it is irrelevant where other production tubing valves 126 may be positioned while calibrating an individual production tubing valve 26. In addition the resistance within valve control system 128 may be irrelevant as well system 100 may depend on changes in resistance rather than total resistance. This may serve as a base for future measurements.

For example, valve control system 128 may comprise six individual zones 124. Each zone 124, may comprise a production tubing valve 126. All production tubing valves 126 may be brought to a closed position and a resistance measurement may be performed. A line resistance of valve control system 128 may be measured, which may be assumed as 150 ohms, which may be recorded as the line resistance plus the resistance of the position sensors 150 in a closed position. Assuming that each production tubing valve 126 has positions from 0 to 10, where 0 may be fully closed and 10 may be fully open, numbers in between may represent various choking positions. Additionally, assuming that each increment in position adds an additional 1,000 ohms may be measured. Then when one of the production tubing valves 126 may be fully opened, a total of an additional 10,000 ohms may be measured from that particular production tubing valve 126. In that scenario, assume that a first one of the production tubing valves 126 may need to be moved to position four, a third one of the production tubing valves 126 may be moved to position six and a fourth one of the production tubing valves 126 to position eight. First, a resistance measurement may be taken, which may be 150 ohms as previously measured. Then, the first one of the production tubing valves 126 may be moved until the total resistance would be 4,150 ohms (4000+150 initial). Next, the third one of the production tubing valves 126 may be moved till the resistance would be 10,150 ohms (4150+6000). Lastly, the third one of the production tubing valves 126 may be moved until total resistance is 18,150 ohms. This logic may then be applied for any desired subsequent movements. At any time valve control system 128 may be recalibrated as previously mentioned.

As illustrated in FIG. 3, a second conductor 154, and a third conductor 156 may operate production tubing valves 126 within a specified zone. For example, second conductor 154 may attach to zones one through four and zone seven. By positively charging or negatively charging second conductor 154 and/or third conductor 156, production tubing valves 126, within a specified zone, may be opened, closed, and/or chocked. For example, a second conductor 154 may be attached to a zone one and a third conductor 156 may also be attached to a zone 1. Zone one may only operate with second conductor 154 positively charged and third conductor 156 negatively charged. Once energized, zone one may manipulate production tubing valve 126. Additionally, zone two may attach to second conductor 154 and third conductor 156, which may only operate when second conductor 154 is negatively charge and third conductor 156 is positively charged. Thus, zone one may be operated independently of zone two, which may depend on the charge within second conductor 154 and third conductor 156. Without limitation, first conductor 152, second conductor 154, and third conductor 156 may attach to any number of zones 124 in any order and/or any sequence which may allow each zone to operate independently of each other, depending on the positive charge and/or negative charge within first conductor 152, second conductor 154, and third conductor 156. It should be noted that production tubing 112 may act as a fourth conductor, as production tubing may be attached directly to any production tubing valve 126 and may be positively and/or negatively charged.

Further illustrated in FIG. 3, diodes 158 may allow zones seven, eight, and/or nine to function properly. A diode may be defined as a device which may have a low resistance to the flow of current in one direction and a high resistance to the flow of current in the opposing direction. For example, zone seven may be activated when second conductor 154 may be set to a positive charge and production tubing 112 may be set to a negative charge. Thus, diodes 158 may allow current to pass through position sensor system 148 without being affected by the internal resistance of position sensors 150, which may be in series before zone seven. This may also apply for zones eight and nine. Position of production tubing valves 126 within zones seven, eight, and nine may not be determined while zone seven may be activated. Zone seven may be deactivated to read the relative position of the production tubing valve 126 within the specified zone. Additionally, diodes 160 may allow position sensor system 148 to operate independently of each other. For example, the position of diodes 160 may only allow positive and/or negative charge to move through a specified conductor. Specifically, the conductor in which diode 160 may be attached. Thus, by alternating between positive and negative charges along the conductors, diodes 160 may help prevent the unwanted activation of production tubing valves 126 as electricity may move in a direction opposite in the way diode 160 is configured.

Resistance may be measured, as described above, by any suitable device. A suitable device may be, but is not limited to a multimeter, ohmmeter, by simply passing a known current and measuring the resulting voltage, or setting a known voltage and measuring the resulting current. Resistance measurements may be performed at the surface, by an operator and/or information handling unit. An information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. In examples, a measured resistance readout may be displayed to an operator on the information handling unit. Additionally, the operator may direct the information handling unit to move positions of production tubing valves 126 (referring to FIG. 1). The information handling system may be connected to hydraulic system 134 (referring to FIG. 2) which may move production tubing valves 126 to any desired position.

While the preceding description is directed to position sensing of production tubing valves 126 the techniques described herein should not be limited to use with production tubing valves 126. The disclosed techniques may be applicable to sensing position of any of a variety or type of downhole equipment. Without limitation, downhole tools may comprise other types of valves (e.g., ball valves, sliding sleeves, etc.), packers, traveling joints, hydraulic disconnects, and/or electric disconnects (not illustrated). In examples, measured resistance within a line may increase and/or decrease when a packer may go from un-deployed to deployed or vice versa. The drop and/or increase in line resistance may be indicators of the deployment and/or un-deployment of a packer. Likewise, resistance may be measured for hydraulic disconnects and/or electric disconnects. Resistance may increase and/or decrease when hydraulic disconnects and/or electric disconnects may be activated or deactivated. The increase and/or decrease measured in the line may indicate if a hydraulic disconnect and/or electric disconnect may be activated or deactivated. Traveling joints may further be monitored as a traveling joint may move through well system 100 (in reference to FIG. 1). Without limitation, as traveling joints move, the measured line resistance may increase and/or decrease as the traveling joint moves. Thus, an increase and/or decrease in measured resistance may indicate the movement, and in turn, where the traveling joint may be disposed.

A system and method for a position sensor system in a well system. A position sensor system may comprise a downhole tool, a position sensor attached to the downhole tool such that resistance of the position sensor changes with position of the downhole tool, a first conductor attached to the position sensor, and a second conductor attached to the position sensor as an electrical ground. A method for determining position of a downhole tool may comprise taking a first measurement of a line resistance and moving the downhole tool, wherein moving the downhole tool increases or decreases the line resistance. The method may further comprise taking a second measurement of the line resistance, wherein the second measurement provides an indication of the position of the downhole tool. This system and method may include any of the various features of the compositions methods, and systems disclosed herein, including one or more of the following features in any combination.

The position sensor system may comprise a first hydraulic line and a second hydraulic line, which may be operable to move the downhole tool between a plurality of positions. The position sensor system may move between the plurality of positions, which may increase and/or decrease a line resistance within the position sensor system and the line resistance may be a measurement between the first conductor and the second conductor. The position sensor system, where the downhole tool may be a production tubing valve, a packer, a traveling joint, a hydraulic disconnect, or an electric disconnect. The position sensor may be connected to an information handling system and the position sensor may be connected to the downhole tool. The information handling system may be operable to controlling the first hydraulic line and the second hydraulic line, which may be operable to moving the downhole tool between a plurality of positions. The first hydraulic line and the second hydraulic line may move a plurality of downhole tools and wherein moving between the plurality of positions increases and/or decreases a line resistance within the position sensor system. The line resistance may be a measurement between the first conductor and the second conductor, where the first conductor may be attached to a plurality of position sensors in series and the second conductor may be a production tubing. The position sensor system may further comprises a diode, where the diode may allow multiple zones to operate independently of each other. The position sensory system may operate SOVs, motors, and/or actuators, which may operate a downhole tool.

The method may comprise measuring the line resistance through a first conductor and a production tubing with the production tubing valve at a first position, measuring a line resistance through a first conductor and a production tubing with the production tubing valve at a final position, and determining the total line resistance between a first position and a final position to calibrate the position system. Identifying a set resistance to change the production tubing valve from a position to a second position, and positioning the production tubing valve at a set position based on the line resistance measured from the first conduit and the production tubing. Measuring the line resistance of a plurality of production tubing valves at a production state and moving the plurality of production tubing valves to the first position. Measuring the line resistance of the plurality of production tubing valves at the first position and moving the plurality of the production tubing valves to the final position. Measuring the line resistance of the plurality of the production tubing valves at the final position. Determining the line resistance for each of the plurality of the production tubing valves positions. Moving the plurality of the production valves to the production state positions. Adjusting the plurality of the production valves from the production state positions to a secondary production state positions. Moving the plurality of the production valves between the production state positions and the secondary production state position is performed by a hydraulic line.

The preceding description provides various embodiments of the systems and methods of use disclosed herein which may contain different method steps and alternative combinations of components. It should be understood that, although individual embodiments may be discussed herein, the present disclosure covers all combinations of the disclosed embodiments, including, without limitation, the different component combinations, method step combinations, and properties of the system.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

Therefore, the present embodiments are well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Although individual embodiments are discussed, the invention covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present invention.

What is claimed is:

1. A position sensor system for a well system comprising:

a plurality of downhole tools;

a plurality of position sensors connected in series, wherein the plurality of position sensors are attached to the plurality of downhole tools such that resistance of each of the plurality of position sensors changes with respect to a position of a respective downhole tool of the plurality of downhole tools; and a first conductor and a second conductor, wherein each of the plurality of position sensors are connected in series along the first conductor.

2. The position sensor system of claim 1, wherein a first hydraulic line and a second hydraulic line are operable to move the plurality of downhole tools between a plurality of positions.

3. The position sensor system of claim 2, wherein moving between the plurality of positions increases or decreases a line resistance within the position sensor system and wherein the line resistance is a measurement between the first conductor and the second conductor.

4. The position sensor system of claim 3, wherein the plurality of downhole tools are a valve, a packer, a traveling joint, a hydraulic disconnect, or an electric disconnect.

5. The position sensor system of claim 1, wherein the position sensor is a potentiometer coupled to a piston of a valve.

6. The position sensor system of claim 1, further comprising an information handling system operable to control a first hydraulic line and a second hydraulic line, which are operable to move the plurality downhole tools between a plurality of positions.

7. The position sensor system of claim 6, wherein moving between the plurality of positions increases or decreases a line resistance within the position sensor system.

8. The position sensor system of claim 7, wherein the line resistance is a measurement between the first conductor and the second conductor, and wherein the second conductor is a production tubing.

9. The position sensor system of claim 1, further comprising a plurality of diodes, wherein at least one diode of a plurality of diodes is connected in parallel to each of the plurality of position sensors such that the first conductor provides a return line for powering the plurality of downhole tools.

10. The position sensor system of claim 9, where the position sensor system monitors solenoid operated valves, motors, and actuators, which operate the plurality of downhole tools.

11. A method for determining a position of a downhole tool comprising:

positioning a plurality of downhole tools in a wellbore, wherein at least one position sensor of a plurality of position sensors is attached to teach of the plurality of downhole tools;

attaching the plurality of position sensors in series along a first conductor;

taking a first measurement of a line resistance between a first conductor and, a second conductor;

moving at least one of the downhole tools, wherein moving the at least one of the downhole tools increases or decreases the line resistance; and taking a second measurement of the line resistance between the first conductor and the second conductor, wherein the second measurement provides an indication of the position of the at least one of the downhole tools.

12. The method of claim 11, wherein the plurality of downhole tools are a production tubing valve, a packer, a traveling joint, a hydraulic disconnect, or electric disconnect.

13. The method of claim 11, wherein moving the at least one of the plurality of downhole tools comprises moving the at least one of the downhole tools from a closed position to an open position.

14. The method of claim 11, wherein the at least one position sensor increases or decreases the line resistance as the at least one of the downhole tools is moved.

15. The method of claim 14, wherein the at least one position sensor is a potentiometer.

16. The method of claim 11, further comprising disposing the plurality of downhole tools into a plurality of zones.

17. The method of claim 16, further comprising a plurality of diodes, wherein at least one diode of a plurality of diodes is connected in parallel to each of the plurality of position sensors such that the first conductor provides a return line for powering the plurality of downhole tools.

18. The method of claim 11, further comprising repeating the first measurement and the second measurement for each of the plurality of downhole tools in a plurality of zones.

19. The method of claim 11, wherein moving the plurality of downhole tools is performed by a hydraulic line.

* * * * *